US008175866B2

(12) United States Patent
Huang et al.

(10) Patent No.: US 8,175,866 B2
(45) Date of Patent: May 8, 2012

(54) METHODS AND APPARATUS FOR POST-PROCESSING OF SPEECH SIGNALS

(75) Inventors: Heyun Huang, Shanghai (CN); Fuhuei Lin, Cupertino, CA (US)

(73) Assignee: Spreadtrum Communications, Inc., George Town, Grand Cayman (KY)

( * ) Notice: Subject to any disclaimer, the term of this patent is extended or adjusted under 35 U.S.C. 154(b) by 1058 days.

(21) Appl. No.: 12/047,232

(22) Filed: Mar. 12, 2008

(65) Prior Publication Data

US 2008/0228474 A1 Sep. 18, 2008

(30) Foreign Application Priority Data

Mar. 16, 2007 (CN) ..... 2007 1 0038147

(51) Int. Cl.
*G10L 11/04* (2006.01)
*G10L 19/14* (2006.01)

(52) U.S. Cl. ..... 704/207; 704/205

(58) Field of Classification Search ..... 704/200–230
See application file for complete search history.

(56) References Cited

U.S. PATENT DOCUMENTS

| | | | | |
|---|---|---|---|---|
| 5,946,651 | A * | 8/1999 | Jarvinen et al. | 704/223 |
| 6,018,706 | A * | 1/2000 | Huang et al. | 704/207 |
| 6,704,701 | B1 * | 3/2004 | Gao | 704/207 |
| 7,529,660 | B2 * | 5/2009 | Bessette et al. | 704/205 |
| 7,606,703 | B2 * | 10/2009 | Unno | 704/219 |

* cited by examiner

*Primary Examiner* — Samuel G Neway

(57) ABSTRACT

A method for post-processing of speech signals includes using a pitch correction filter, a pitch weight parameter adjustor, and a first pitch enhancement filter to process the input signal into a first output signal; summing both the input signal and the first output signal as a second output signal; and using a second pitch enhancement filter to process the second output signal. Furthermore, another method for post-processing of speech signals includes using a second pitch enhancement filter to process the input signal into a second output signal; using a pitch correction filter, a pitch weight parameter adjustor, and a first pitch enhancement filter to process the second output signal into a first output signal; and summing both the second output signal and the first output signal as a final output signal. The two methods can simultaneously realize pitch emphasis and enhancement with low computation complexity.

20 Claims, 4 Drawing Sheets

METHODS AND APPARATUS FOR POST-PROCESSING OF SPEECH SIGNALS

CROSS-REFERENCE TO RELATED APPLICATION(S)

This application claims priority to Chinese Patent Application No. 200710038147, filed Mar. 16, 2007, the disclosure of which is incorporated herein by reference in its entirety.

TECHNICAL FIELD

The present invention is related to methods and apparatus for post-processing of signals (e.g., speech signals) and associated methods.

BACKGROUND

Speech codec is typically based on Coded Excited Linear Prediction (CELP). FIGS. 1 and 2 schematically illustrate typical implementations of an adaptive codebook and a fixed codebook, respectively, used for constructing an excitation signal of speech. Although the CELP technique can approximate practical speech, some distortions of synthesized speech signal inevitably exist. Especially in low bit-rate speech coding, the distortion can be quite severe, and thus requiring post-processing of decoded speech signal.

Traditional post-processing techniques in AMR-WB and AMR-WB+ codec include pitch emphasis, frequency-selective pitch enhancement, etc., some of which are designed to reduce pitch distortion due to inadequate bits under low bit-rate conditions. Current post-processing techniques for pitch enhancement can be divided into two categories. One technique is to divide the input signal into multiple frequency bands and then to enhance pitch components of speech in certain frequency bands but not all frequency bands. The output of post-processing signals is the summation of signals from all the bands. One disadvantage of this technique is that the application of multiple bandpass filters requires a large computation burden. The other technique is to directly add the adaptive codebook driven excitation into total excitation. Applying this technique requires computing certain internal parameters using multiplications and square computations, and thus causing excessive computational complexity.

DETAILED DESCRIPTION

Overview

Figure 1:
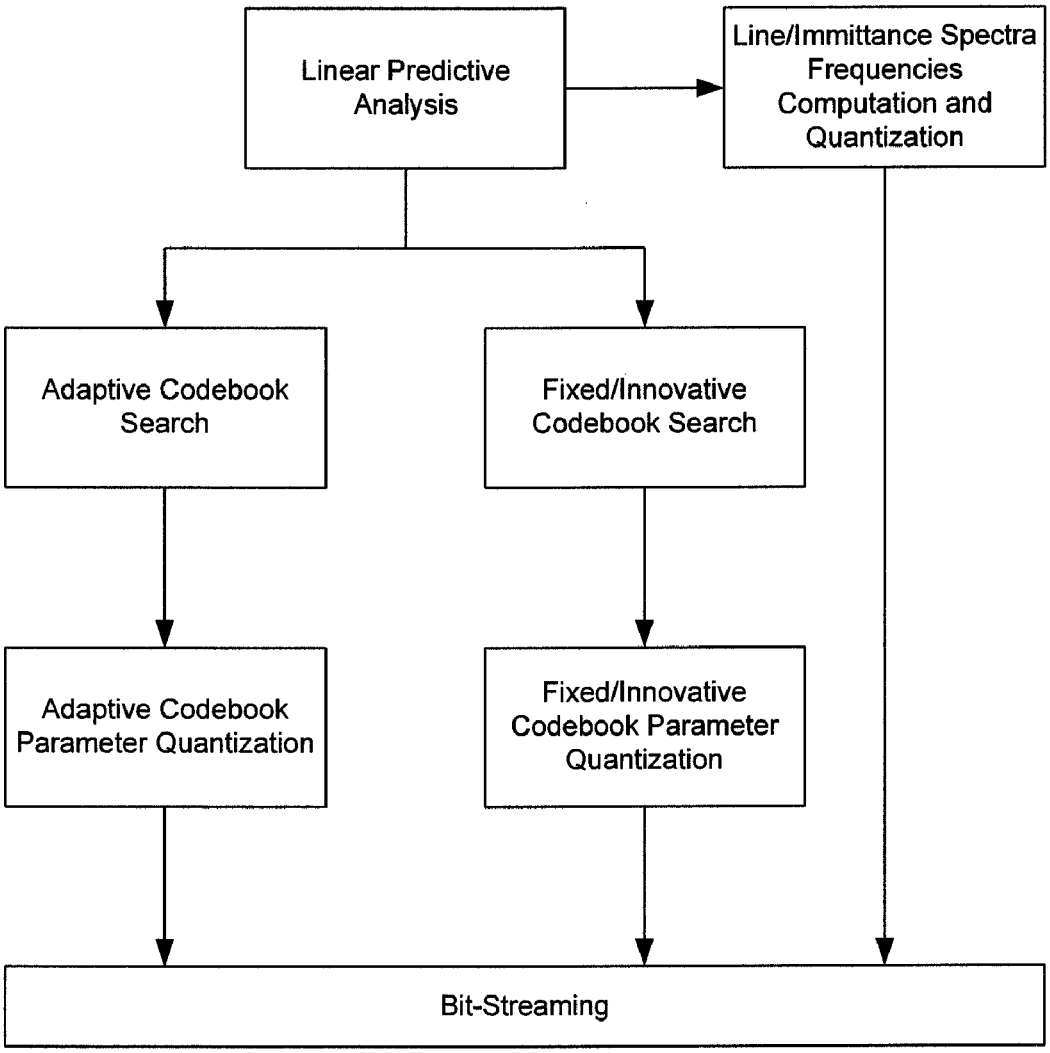
FIG. 1 (Prior Art)
FIG. 1 is a flowchart illustrating a CELP-based speech encoding process in accordance with the prior art.
Figure 2:
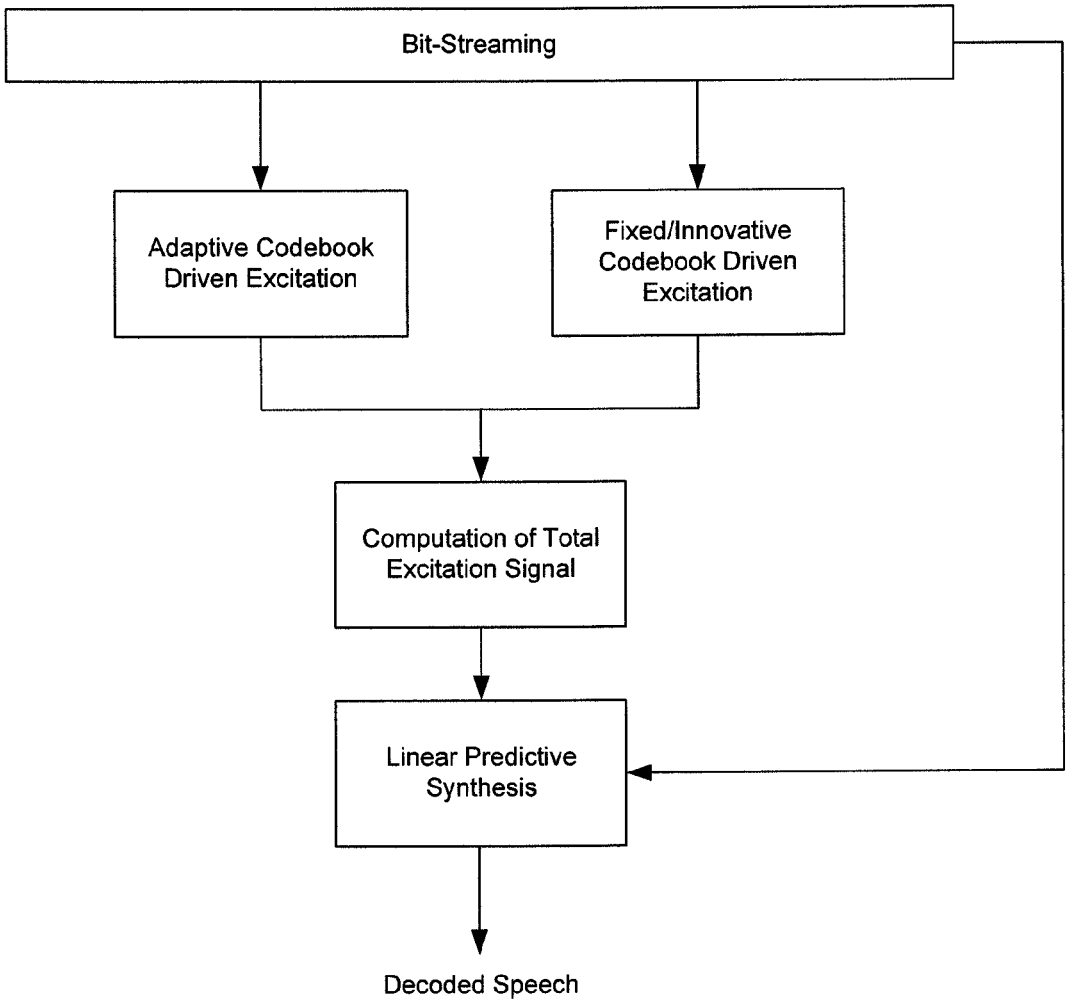
FIG. 2 (Prior Art)
FIG. 2 is a flowchart illustrating a CELP-based speech decoding process in accordance with the prior art.

Described in detail below are several embodiments of methods and apparatus related to post-processing of adaptive codebook driven excitation, fixed codebook driven excitation, total excitation, and decoded speech signals. Several embodiments of the invention provide post-processing methods of speech or excitation signals designed to simultaneously realize pitch emphasis and enhancement with low computation complexity.

Those skilled in the relevant art will appreciate that the invention can be practiced with any of various communications, data processing, or computer system devices, including: hand-held devices (including personal digital assistants (PDAs)), wearable computers, all manner of cellular or mobile phones, multi-processor systems, microprocessor-based or programmable consumer electronics, network PCs, mini-computers, mainframe computers, and the like. Aspects of the invention may be stored or distributed on computer-readable media, including magnetically or optically readable computer discs, hard-wired or preprogrammed chips (e.g., EEPROM semiconductor chips), nanotechnology memory, biological memory, or other data storage media. Indeed, computer implemented instructions, data structures, screen displays, and other data under aspects of the invention may be distributed over the Internet or over other networks (including wireless networks), on a propagated signal on a propagation medium (e.g., an electromagnetic wave(s), a sound wave, etc.) over a period of time, or they may be provided on any analog or digital network (packet switched, circuit switched, or other scheme).

For post-processing of a speech or excitation signal, several embodiments of a method include the following procedures: (1) using a pitch correction filter, a pitch weight parameter adjustor, and a first pitch enhancement filter to process the speech or excitation signal; (2) summing both input and output signals of procedure (1) as the output signal of the current procedure; and (3) using a second pitch enhancement filter to process the output signal from procedure (2).

In certain embodiments, the method can also be implemented as: (1) using the second pitch enhancement filter to process the speech or excitation signal; (2) using the pitch correction filter, pitch weight parameter adjustor, and the first pitch enhancement filter to process the output signal from procedure (1); and (3) summing both input and output signals of procedure (2) as a final output signal.

Several embodiments of the method can simultaneously implement both pitch emphasis and pitch enhancement. The pitch enhancement filter can remove the inter-harmonic noise, which brings the auditory distortion. The post-processing filter of the present invention is generally equivalent in function as to adding the original speech signal and the filtered original speech signal using both a long-term filter and a specific filter. Therefore, the pitch component can have a smaller auditory distortion with a relative low calculation complexity.

Figure 3:
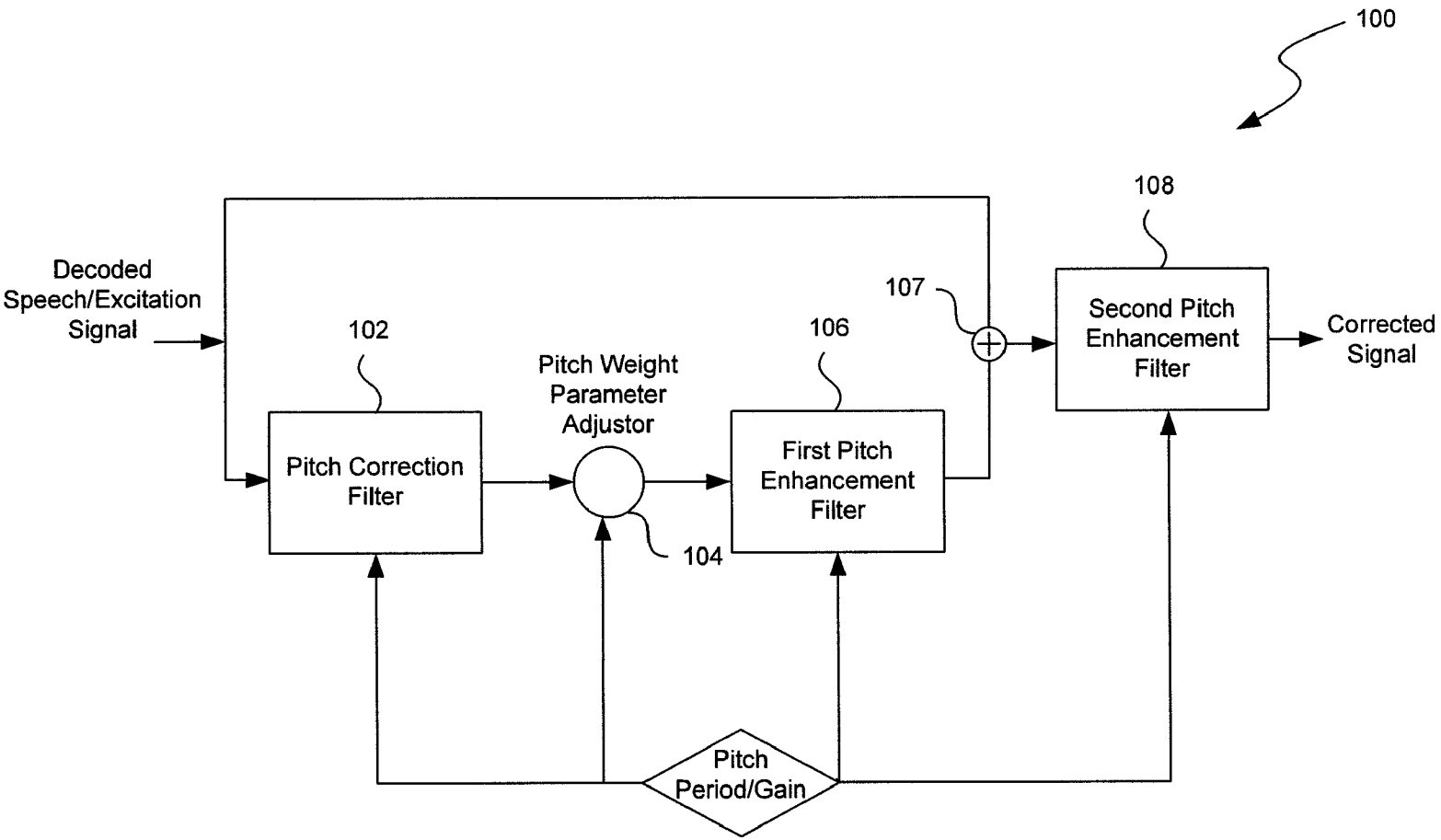
FIG. 3 is a schematic diagram illustrating a signal post-processing apparatus in accordance with an embodiment of the present invention.

In one embodiment, as illustrated in FIG. 3, the post-processing filter 100 can be implemented as: (1) using a pitch correction filter 102, pitch weight parameter adjustor 104, and a first pitch enhancement filter 106 to process the speech or excitation signal; (2) summing both input and output signals of procedure (1) with a summing device 107 as the output signal of the current procedure; and (3) using a second pitch enhancement filter 108 to process the output signal from procedure (2).

Figure 4:
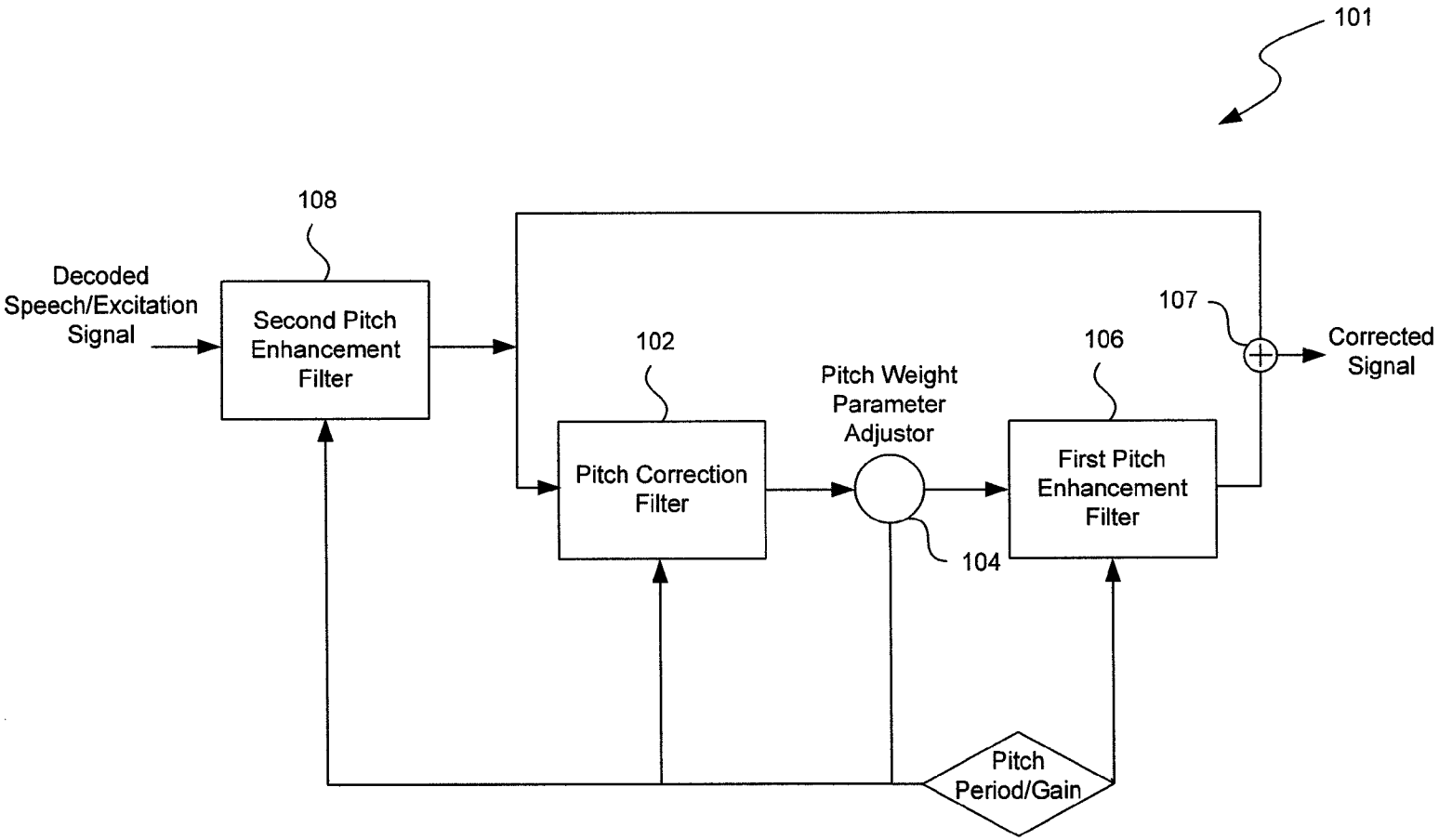
FIG. 4 is a schematic diagram illustrating a signal post-processing apparatus in accordance with an embodiment of the present invention.

In another embodiment, as illustrated in FIG. 4, the post-processing filter 100 can be implemented as: (1) using the second pitch enhancement filter 108 to process the speech or excitation signal; (2) using the pitch correction filter 102, pitch weight parameter adjustor 104, and the first pitch enhancement filter 106 to process the output signal from procedure (1); and (3) summing both input and output signals of procedure (2) with a summing device 107 as a final output signal.

In the two embodiments above, the pitch correction filter 102, the pitch weight parameter adjustor 104, and the first pitch enhancement filter 106 are illustrated in particular orders. However, in other embodiments, the pitch correction filter 102, the pitch weight parameter adjustor 104, and/or the first pitch enhancement filter 106 can have other orders.

The pitch correction filter 102 is configured to modify gains of individual harmonics in the frequency domain. All-pass filter, which multiplies gains of each harmonics by 1, is an example of the pitch correction filter 102. The corresponding transfer function is $H_0(z)=1$. Another example of the pitch correction filter 102 is a comb filter having a transfer function of $H_0(z)=1+az^{-T}$.

Both the first and second pitch enhancement filters 106, 108 can have a transfer function as: $H_{LT}(z)=\lambda+\eta z^{-T}$, which is typically referred to as a long-term filter. Parameters $\lambda$ and $\eta$ can be selected based on particular applications. For example, the first and second pitch enhancement filters 106 and 108 can have a transfer function as follows:

$$H_{PE}(z)=(1-\alpha)+\alpha z^{-T}$$

where T represents a pitch period, and $\alpha$ refers to a parameter related with a pitch gain.

If the pitch correction filter 102 has a transfer function of $H_0(z)$; the first pitch enhancement filter 106 has a transfer function of $H_{PE1}(z)$; and the second pitch enhancement filter 108 has a transfer function of $H_{PE2}(z)$, the total filter transfer function can be described in the frequency domain (i.e., the Z-domain) as:

$$H(z)=H_{PE2}(z)(1+\beta H_{PE1}(z)H_0(z))$$

where $\beta$ is the pitch weight parameter that can be empirically determined for controlling pitch amplification.

In another example, pitch correction can also be implemented as follows:

$$H(z)=((1-\alpha)+\alpha z^{-T})(1+\beta((1-\alpha)+\alpha z^{-T})H_0(z))$$

Several embodiments of the post-processing method can be implemented on the decoded speech signal or the decoded excitation signal. As a result, the post-processing filter 100 described above can be positioned after the total speech decoder (to process the decoded speech signal) or in any equivalent position, such as the position after the formulation of decoded excitation signal. It should be noted that parameters T, $\alpha$ and $\beta$ can be acquired from the speech decoder, or any pitch tracking method.

Several embodiments of the pitch correction filter 102 and associated methods can be implemented in any CELP-based speech decoder, including AMR-WB, AMR-WB+ and G.729. In other embodiments, several embodiments of the pitch correction filter 102 can be implemented in other types of speech decoders incorporated in a cellular phone, a wireless phone, a wireless network card, and/or other suitable wireless communication devices.

The teachings of the invention provided herein can be applied to other systems, not necessarily the system described above. The elements and acts of the various embodiments described above can be combined to provide further embodiments.

While the above description describes certain embodiments of the invention and describes the best mode contemplated, no matter how detailed the above appears in text, the invention can be practiced in many ways. Details of the system may vary considerably in implementation details, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

While certain aspects of the invention are presented below in certain claim forms, the inventors contemplate the various aspects of the invention in any number of claim forms. For example, while only one aspect of the invention is recited as a means-plus-function claim under 35 U.S.C §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for".) Accordingly, the inventors reserve the right to add additional claims after filing the application to pursue such additional claim forms for other aspects of the invention.

We claim:

1. A method for post-processing of an input signal, comprising:

using a pitch correction filter, a pitch weight parameter adjustor, and a first pitch enhancement filter to process the input signal into a first output signal;

summing both the input signal and the first output signal as a second output signal; and using a second pitch enhancement filter to process the second output signal.

2. The method of claim 1, wherein the pitch correction filter is configured to modify gains of individual harmonics in frequency domain, and wherein the pitch correction filter includes an all-pass filter having a transfer function of $H_0(z)=1$ or a comb filter having a transfer function of $H_0(z)=1+az^{-T}$, where T and a are a pitch period and a total gain modification factor, respectively.

3. The method of claim 1, wherein the pitch weight parameter is a fixed empirical parameter.

4. The method of claim 1, wherein both the first and second pitch enhancement filters include a long-term filter having a transfer function of: $H_{LT}(z)=\lambda+\eta z^{-T}$.

5. The method of claim 4, wherein the long-term filter has a transfer function of $H_{PE}(z)=(1-\alpha)+\alpha z^{-T}$, where $\alpha$ is a parameter related to pitch amplification, and T is a pitch parameter corresponding to a signal of a current frame.

6. The method of claim 1, wherein the pitch correction filter, the pitch weight parameter adjustor, and the first pitch enhancement filter are arranged in a random order.

7. The method of claim 1, wherein the input signal includes either a decoded speech signal or a decoded excitation signal.

8. A method for post-processing of an input signal, comprising:

using a second pitch enhancement filter to process the input signal into a second output signal;

using a pitch correction filter, a pitch weight parameter adjustor, and a first pitch enhancement filter to process the second output signal into a first output signal; and summing both the second output signal and the first output signal as a final output signal.

9. The method of claim 8, wherein the pitch correction filter is configured to modify gains of individual harmonics in frequency domain, and wherein the pitch correction filter includes an all-pass filter having a transfer function of $H_0(z)=1$ or a comb filter having a transfer function of $H_0(z)=1+az^{-T}$, where T and a are a pitch period and a total gain modification factor, respectively.

10. The method of claim 8, wherein the pitch weight parameter is a fixed empirical parameter.

11. The method of claim 8, wherein both the first and second pitch enhancement filters include a long-term filter having a transfer function of: $H_{LT}(z)=\lambda+\eta z^{-T}$.

12. The method of claim 11, wherein the long-term filter has a transfer function of $H_{PE}(z)=(1-\alpha)+\alpha z^{-T}$, where $\alpha$ is a parameter related to pitch amplification, and T is a pitch parameter corresponding to a signal of a current frame.

13. The method of claim 8, wherein the pitch correction filter, the pitch weight parameter adjustor, and the first pitch enhancement filter are arranged in a random order.

14. The method of claim 8, wherein the input signal includes either a decoded speech signal or a decoded excitation signal.

15. An apparatus for post-processing of an input signal, comprising:

a pitch correction filter, a pitch weight parameter adjustor, and a first pitch enhancement filter coupled to one another and configured to process the input signal into a first output signal;

a summing device configured to sum both the input signal and the first output signal as a second output signal; and a second pitch enhancement filter coupled to the summing device and configured to process the second output signal.

16. The apparatus of claim 15, wherein the pitch correction filter is configured to modify gains of individual harmonics in frequency domain, and wherein the pitch correction filter includes an all-pass filter having a transfer function as $H_0(z)=1$ or a comb filter having a transfer function as $H_0(z)=1+az^{-T}$, where T and a are a pitch period and a total gain modification factor, respectively.

17. The apparatus of claim 15, wherein the pitch weight parameter is a fixed empirical parameter.

18. The apparatus of claim 15, wherein both the first and second pitch enhancement filters include a long-term filter having a transfer function of $H_{LT}(z)=\lambda+\eta z^{-T}$.

19. The apparatus of claim 18, wherein the long-term filter has a transfer function of $H_{PE}(z)=(1-\alpha)+\alpha z^{-T}$, where $\alpha$ is a parameter related to pitch amplification, and T is a pitch parameter corresponding to a signal of a current frame.

20. The apparatus of claim 15, wherein the pitch correction filter, the pitch weight parameter adjustor, and the first pitch enhancement filter are arranged in a random order.

* * * * *